United States Patent [19]

Kitano et al.

[11] 4,011,641

[45] Mar. 15, 1977

[54] JACKETED ROLLER FOR SYNTHETIC YARN SPINNING APPARATUS

[76] Inventors: Yoshio Kitano, No. 40 Yamashina Nishino Rikyu-cho, Higashiyama, Kyoto; Takuma Katsumata, No. 1-47, Oaza Takagami, Nakanosho, Inazawa, Aichi, both of Japan

[22] Filed: Jan. 2, 1975

[21] Appl. No.: 538,213

Related U.S. Application Data

[62] Division of Ser. No. 314,419, Dec. 12, 1972, abandoned.

[30] Foreign Application Priority Data

Dec. 17, 1971 Japan ..... 46-102895
May 30, 1972 Japan ..... 47-054191

[52] U.S. Cl. ..... 28/71.3; 219/469; 425/66

[51] Int. Cl.[2] ..... D02J 1/22

[58] Field of Search ..... 28/71.3, 59.5; 219/469, 219/470, 471; 165/89, 104, 105; 425/66

[56] References Cited

UNITED STATES PATENTS

| | | | |
|---|---|---|---|
| 2,739,218 | 3/1956 | Wennerlund | 219/469 |
| 3,562,489 | 2/1971 | Lenk | 219/469 |
| 3,600,550 | 8/1971 | Katsumata | 219/10.61 A |

*Primary Examiner*—Louis K. Rimrodt
*Attorney, Agent, or Firm*—Kurt Kelman

[57] ABSTRACT

The first-state jacketed roller in an apparatus for spin drawing synthetic fiber comprises a roller rotatably mounted on a shaft and encompassing a fixed, non-rotatable inner core. The roller includes an electrically conductive tubular member coaxial with, and hermetically affixed to, the inner wall of the roller. A plurality of bore holes extend in the conductive member parallel to the roller axis and are coextensive therewith, and a heat transfer fluid fills each bore hole. The fluid divides into a liquid and a vapor phase when the roller is heated and rotation of the roller forces the liquid phase outwardly under centrifugal force into engagement with the outer portion of each bore hole.

3 Claims, 13 Drawing Figures

Fig. 2e
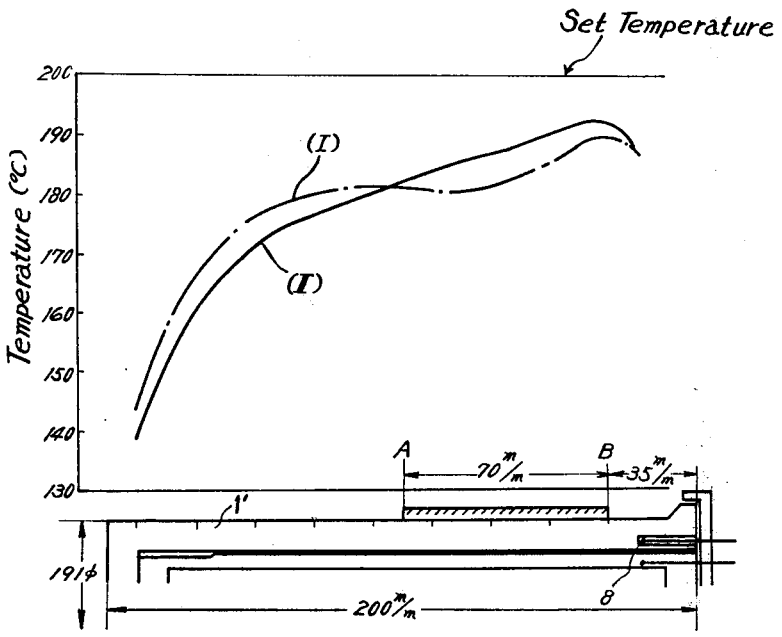
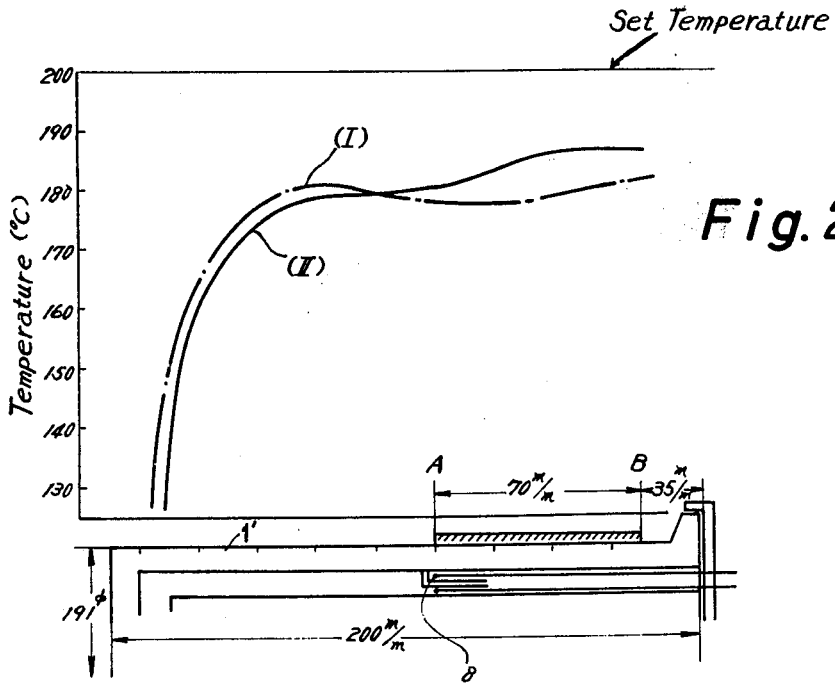
Fig. 2f

JACKETED ROLLER FOR SYNTHETIC YARN SPINNING APPARATUS

This is a division of our copending application Ser. No. 314,419, filed Dec. 12, 1972, now abandoned.

The present invention relates to an improvement in an apparatus for spin drawing synthetic fiber, wherein a yarn is heat treated in successive stages on heated rollers each rotating at a speed higher than that of the preceding stage, and more particularly to a jacketed, fluid-containing, induction-heated roller for the first stage.

In spin drawing synthetic fibers, a high winding speed is generally required and this causes many technical problems. In heat treating systems for freshly spun synthetic filaments or yarn, the yarn is directed from the spinning head to the rotating heated roller of a first stage, and then to successive heating stages, and the heated rollers tend to be heavily loaded, causing an unfavorable temperature distribution over the length of the rollers, which has a severe effect on the quality of the yarn.

It is the primary object of this invention to provide a special heated roller for the first stage of such an apparatus, such roller having an increased thermal capacity and being capable of maintaining a uniform temperature over the entire surface thereof. Combining such a special first-stage roller with conventional heated rollers in the successive treating stages enables the apparatus to be operated at higher drawing and winding speeds, with high efficiency and without damage to the quality of the yarn.

This object is accomplished in accordance with the invention with a jacketed roller comprising a shaft and a fixed, non-rotatable inner core fastened about the shaft. The roller is rotatably mounted on the shaft and encompasses the core. It includes a tubular, electrically conductive member coaxial with, and hermetically affixed to, the inner wall of the roller. The conductive member has a higher electrical conductivity than the roller. A tubular, non-magnetic reinforcing member is hermetically affixed to the inner surface of the conductive member. A plurality of bore holes extend in the conductive member parallel to the axis of the roller and coextensive therewith, and a heat transfer fluid, such as water, in each bore hole. The fluid divides into a liquid and a vapor phase when the roller is heated and rotation of the roller forces the liquid phase of the fluid radially outwardly under centrifugal force into engagement with the outer portion of each bore hole.

The above and other objects, advantages and features of the present invention will become more apparent from the following detailed description of a now preferred embodiment thereof, taken in conjunction with the accompanying drawing wherein FIGS. 1*a* and 1*b* diagrammatically show an apparatus for spin drawing synthetic fiber in front and side elevational views, respectively;

FIGS. 2*a* to 2*f* show temperature distribution curves for load and no-load conditions of conventional heated rollers used in such apparatus;

FIGS. 3*a* and 3*b* shows like temperature distribution curves for jacketed rollers constructed according to this invention;

Figure 1B:
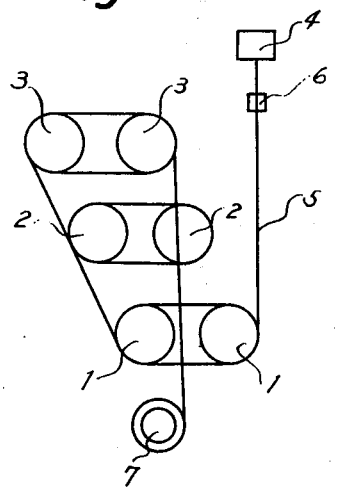
Figure 1A:
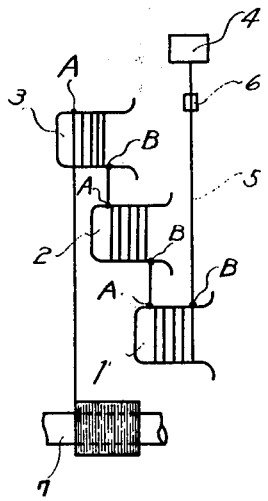

Referring now to the drawing and first to FIGS. 1*a* and 1*b* synthetic filament or yarn 5 is extruded from spinning head 4 and oil-treated at 6, the treated yarn being directed at point B to first-stage heated rollers 1, being wound for several turns about the rollers, is then directed from point A on roller 1 to point B of second-stage heated rollers 2, again wound thereabout and finally directed from point A on roller 2 to third-stage heated rollers 3 whence it is directed to bobbin 7, all in a generally conventional manner. In such spin drawing, it is essential for the yarn to be kept at a constant temperature at point A. Furthermore, it has been found that the heated rollers should be kept at such temperatures and rotating speeds that the first-stage roller 1 is at a temperature between 50° C and 150° C and at 1500 r.p.m., the second-stage roller 2 at 100° C to 250° C and about 4,500 r.p.m., and the third-stage roller 3 at the same temperature as the second-stage roller but at 7,500 r.p.m. In this manner, yarn 5 is preheated by roller 1 and will be heated uniformly in the successive heating stages at progressively increasing speeds before finally being taken up by bobbin 7. Particularly a yarn of relatively high denier will derive a heat energy of about 700 to 800 W from the heat treatment on first-stage rollers 1. Conventional heated rollers employed at this stage produce a non-uniform temperature distribution over the roller periphery, favorably affecting the quality of the yarn. It is known that, even if the temperature distribution over the first-stage roller is kept uniform at no load, the temperature difference between yarn entry point B and yarn exit point A rises to as high as 50° C after several minutes of heavy load operation of conventional heated rollers. Therefore, it has been proposed to keep a temperature sensing and control element embedded in conventional heated rollers directly below yarn exit point A to keep the heating temperature at that point constant even if the temperature distribution over the entire length of the roller varies during operation.

FIGS. 2*a* to 2*f* diagrammatically show temperature distributions for a conventional heated roller for the loaded and noload states, the illustrated roller having a length of 200 mm, and wherein the heating load is applied over 70 mm of external surface from yarn exiting point A to yarn entry point B. Chain-dotted curves (I) show the temperature distribution for the loaded condition while full-line curves (II) show the no-load state.

Figure 2A:
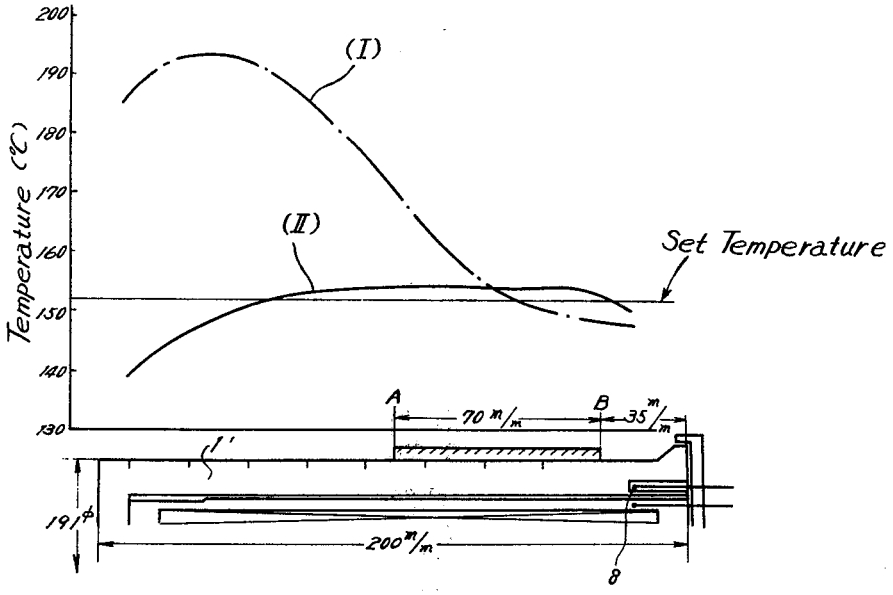

FIG. 2*a* shows the temperature distribution curve for 0.85 KW heat loading, 500 r.p.m. of roller rotation, 152° C set temperature, and the temperature sensing and control element positioned at yarn entry point B.

Figure 2B:
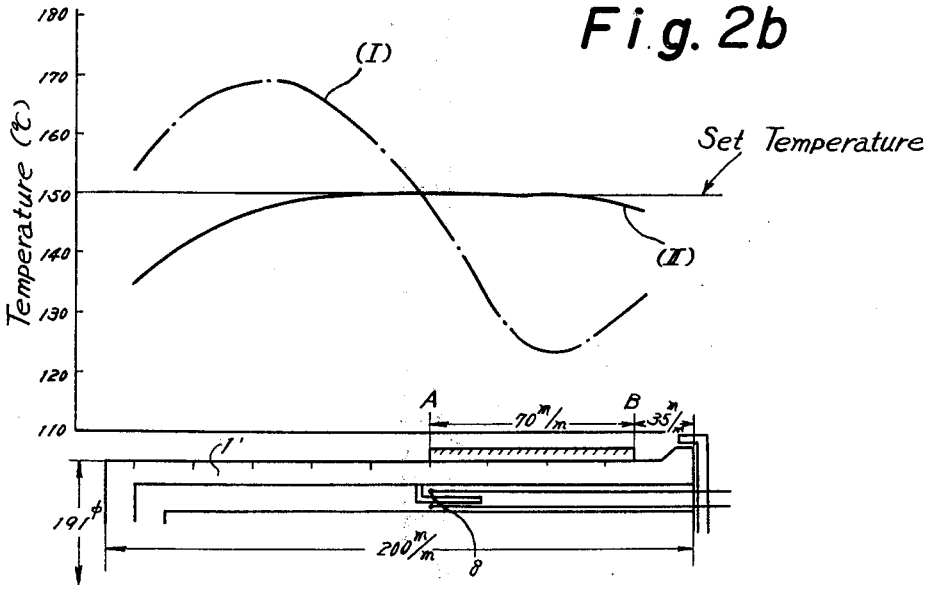

FIG. 2*b* shows the same curve for 0.5 KW, same r.p.m., 150° C set temperature and the control element positioned at yarn exit point A.

Figure 2C:
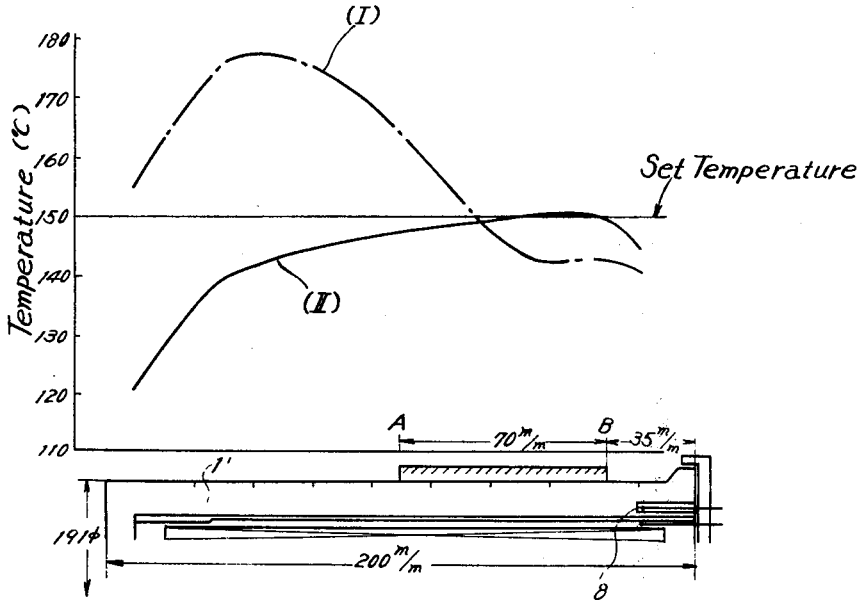

FIG. 2*c* shows the same curve for 0.61 KW, 2,000 r.p.m., 150° C and the control element at B.

Figure 2D:
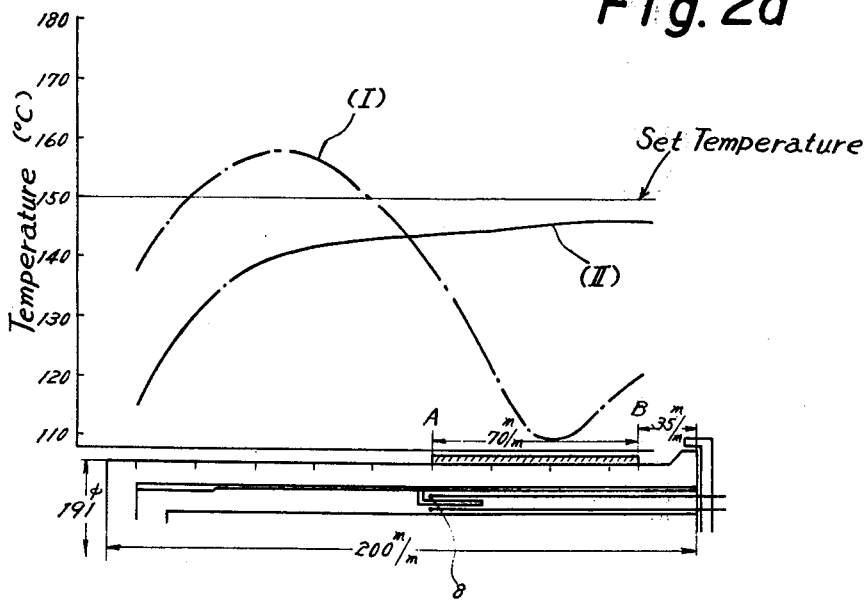

FIG. 2*d* shows the same curve for 0.5 KW and the same temperature and speed as FIG. 2*c* but the control element at A.

FIG. 2*e* shows the same curve for 0.2 KW, 6,000 r.p.m., 200° C and the control element at B while FIG. 2*f* shows the curve for the same operating conditions but the control element at A.

As will be clearly seen from the temperature distribution curves, while the temperature may be uniformly distributed, a temperature difference will inevitably exist between points B and A, which unfavorably affects the quality of the spun yarn. This causes no substantial problem at the higher operating speeds and lighter heat loads, as seen from FIGS. 2*e* and 2*f*, so that conventional heat rollers may be effective used at the second and third stages. But, as FIGS. 2*a* and 2*b* indicate, considerable problems arise at lower operating speeds and heavier loads, as encountered with the rollers of the first stage.

We have found that these problems can be effectively overcome with an induction-heated jacketed roller used in the first stage to maintain a uniform temperature even with heavier heat loading. Since such a roller according to the invention has a uniform temperature distribution in a loaded and no-load state, no special temperature control is needed at yarn exit point A.

Figure 3A:
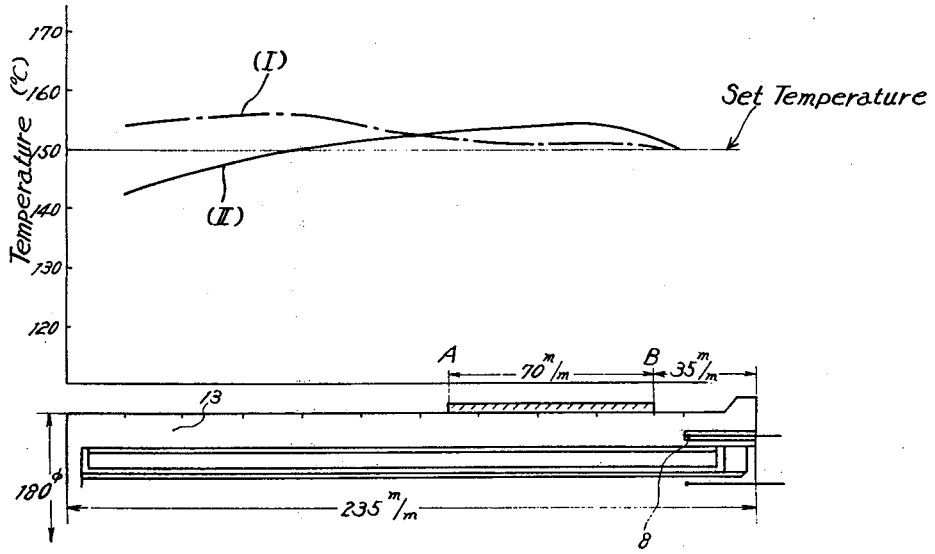
Figure 3B:
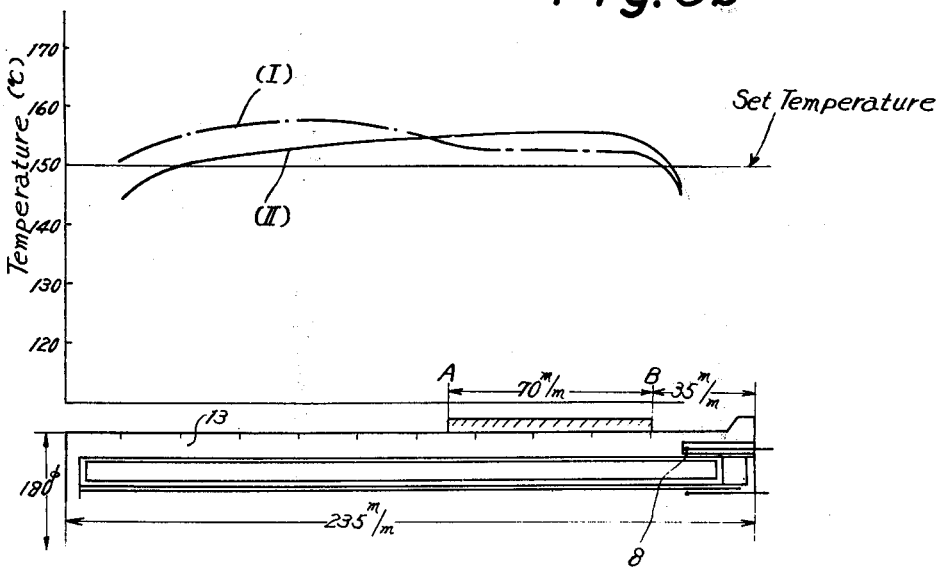

An example of a temperature distribution curve for an induction-heated roller according to this invention is shown in FIGS. 3*a* and 3*b*, FIG. 3*a* showing the curve for a heat load of 0.7 KW, 500 r.p.m. and 150° C set temperature while FIG. 3*b* shows the curve for 0.5 KW, 2,000 r.p.m. and the same temperature in the same manner as FIGS. 2*a* to 2*f*. Clearly, the temperature distribution over the surface of the induction-heated roller is much more uniform than that of the conventioal rollers so that the use of such induction-heated rollers at the first stage of a spin drawing apparatus for synthetic filaments or yarns will greatly improve the yarn quality.

In conventional apparatus of this type, an extremely low temperature has been found at yarn entry point B in the first stage. The number of turns of yarn to be wound on a set of first-stage heated rollers depends on how much preheating is needed and, accordingly, an excess roller width has been needed, necessitating greater depth for the apparatus because the disposition of the second and third stages is determined by the position of the first heating stage. By using the induction-heated roller of the present invention in the first stage, the effective width of the roller may be made smaller and the operation will become easier due to the decreased number of yarn windings on the roller to prevent yarn slippage.

Figure 4:
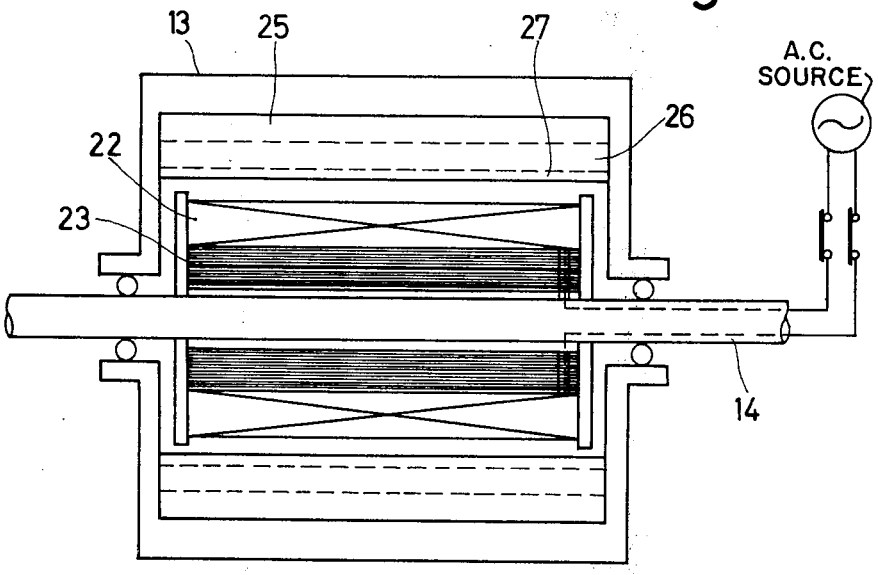
FIG. 4 is a diagrammatic sectional view of a jacketed roller according to the invention.
Figure 5:
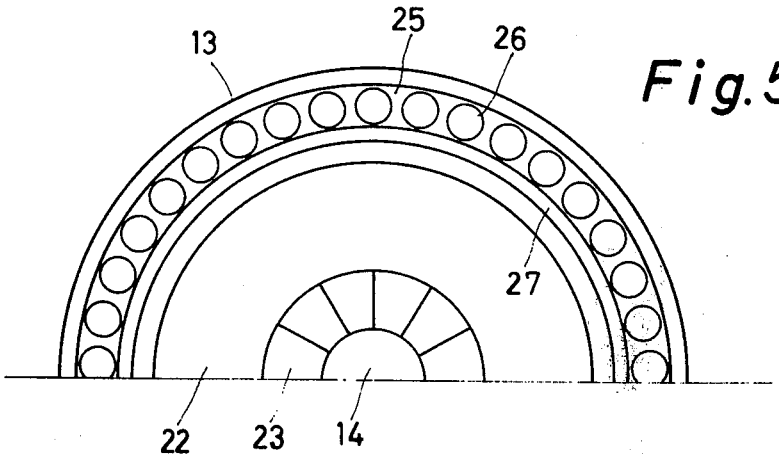
FIG. 5 is a cross section along line B-B of FIG. 4.
Figure 6:
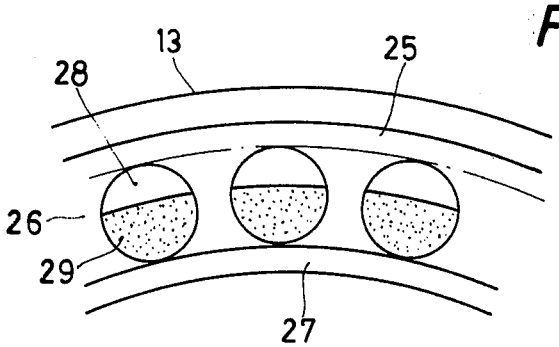
FIG. 6 is an enlarged sectional view of a portion of FIG. 5.

The structure of the induction-heated roller is shown in FIGS. 4 to 6. As shown, the jacketed roller comprises shaft 14 and fixed, non-rotatable inner core 23 fastened about the shaft, the shaft passing through the core for rotation about its axis. Roller 13 is rotatably mounted on the shaft and encompasses inner core 23, the shaft being journaled in anti-friction bearings so that roller 13 may rotate about the shaft.

The roller includes a tubular, electrically conductive member 25 coaxial with, and hermetically affixed to, the inner wall of roller 13. This conductive member is a layer forming an integral body with the roller and has a higher electrical conductivity than the roller. It is comprised of a highly conductive material, such as aluminum, bismuth or copper. A plurality of blind bore holes 26 are provided in member 25 and extend parallel to the axis of the roller and are coextensive therewith in length. A tubular, non-magnetizable reinforcing member 27 is hermetically affixed to the inner surface of conductive member 25, member 27 being, for instance, of stainless steel. A heat transfer fluid, such as water, is in each bore hole 26. When the roller is heated and rotated, the fluid is divided into a liquid phase 28 and a vapor phase 29, and the liquid phase of the fluid is forced radially outwardly under centrifugal force into engagement with the outer portion of each bore hole. This heats the roller.

When an alternating current potential is applied to winding 22 wound on inner core 23 from an external a.c. source, an alternating flux is induced, which links the external wall surface of rotating roller 13 and conductive member 25, which serves as a secondary conductor, to bring them to a highly heated condition, causing the heat transfer fluid in bore holes 26 to be heated. If a heat load is impressed on the surface of the rotating roller, a certain amount of heat will be emitted from the roller surface to produce heat transfer from the heating fluid to the roller body so that heat will be removed due to evaporation from the higher temperature portion of the roller but heat will be given up due to condensation to the lower temperature portion thereof.

In the preferred embodiment illustrated herein, the winding is oriented so that the flux of the electromagnetic induction is parallel to the roller axis. A core consisting of layers wound in this manner reduces the magnetic reluctance in the direction of the axis so that the total thickness of the wound core may be minimized to reduce the over-all dimension of the induction-heated roller.

We claim:

1. In an apparatus for spin drawing synthetic fiber, wherein a yarn is heat treated in successive stages on heated rollers each rotating at a speed higher than that of the preceding stage, the improvement comprising a jacketed, fluid-containing roller for the first stage of the successive stages of heated rollers, the jacketed roller comprising

1. a shaft,

2. a fixed, non-rotatable inner core fastened about the shaft,

3. a roller rotatably mounted on the shaft and encompassing the inner core, the roller including a. a tubular, electrically conductive member coaxial with, and hermetically affixed to, the inner wall of the roller, the conductive member having a higher electrical conductivity than the roller, b. a tubular, non-magnetizable reinforcing member hermetically affixed to the inner surface of the conductive member, c. a plurality of bore holes in the conductive member extending parallel to the axis of the roller and coextensive therewith, d. a heat transfer fluid in each of the bore holes, the fluid dividing into a liquid and a vapor phase when the roller is heated and rotation of the roller forcing the liquid phase of the fluid radially outwardly under centrifugal force into engagement with the outer portion of each bore hole.

2. In the apparatus of claim 1, an external alternating current source, the inner core including a winding heating the conductive member by electromagnetic induction upon being excited by the a.c. source.

3. In the apparatus of claim 2, the winding being oriented so that the flux of the electromagnetic induction is parallel to the roller axis.

* * * * *